US006463697B2

(12) United States Patent
Weder et al.

(10) Patent No.: US 6,463,697 B2
(45) Date of Patent: Oct. 15, 2002

(54) FLORAL SHIPPING CONTAINER

(75) Inventors: Donald E. Weder, Highland, IL (US); Ole B. Nissen, Hobe Sound, FL (US)

(73) Assignee: Southpac Trust International, Inc.

( * ) Notice: Subject to any disclaimer, the term of this patent is extended or adjusted under 35 U.S.C. 154(b) by 0 days.

(21) Appl. No.: 09/884,599

(22) Filed: Jun. 19, 2001

(65) Prior Publication Data

US 2001/0035364 A1 Nov. 1, 2001

(51) Int. Cl.[7] ..... A01G 9/02; B65D 85/52

(52) U.S. Cl. ..... 47/84; 706/423; 706/446; 211/74

(58) Field of Search ..... 206/423, 443, 206/446; 47/72, 84; 211/74

(56) References Cited

U.S. PATENT DOCUMENTS

| | | | | |
|---|---|---|---|---|
| 1,116,752 | A | 11/1914 | Stolk | |
| 2,126,106 | A | 8/1938 | Goldberg | 206/443 |
| 2,158,756 | A | 5/1939 | Knorpp | 706/443 |
| 3,127,011 | A | 3/1964 | Weddle | |
| 3,259,236 | A | 7/1966 | Cole | 206/423 |
| 3,643,812 | A | 2/1972 | Mander et al. | 211/74 |
| 3,924,354 | A | 12/1975 | Gregoire | 706/423 |
| 3,973,356 | A | 8/1976 | Schactt | |
| 4,071,064 | A | 1/1978 | Saul | 206/423 |
| 4,075,786 | A | 2/1978 | van Zyl | 47/84 |
| 4,662,107 | A | 5/1987 | Van Den Kieboom | 47/84 |
| 4,826,003 | A | 5/1989 | Levy | 206/443 |
| 4,915,224 | A | 4/1990 | Wulf et al. | 206/423 |
| 4,941,572 | A | 7/1990 | Harris | 206/423 |
| 5,205,108 | A | 4/1993 | Weder et al. | |
| 5,996,818 | A | 12/1999 | Boje et al. | 211/74 |

*Primary Examiner*—Bryon P. Gehman
(74) *Attorney, Agent, or Firm*—Dunlap, Codding & Rogers, P.C.

(57) ABSTRACT

A floral shipping container comprising a base portion, a tube and a lid. The base portion has sidewalls, an upper end, a closed lower end and a retaining space encompassed by the sidewalls, the upper end, and the lower end thereof. The tube is adapted to receive at least one or a plurality of flowers. The tube is supported by the upper end of the base portion such that the tube extends into the retaining space of the base portion. The lid is supported by the base portion such that the lid extends above the upper end of the base portion to encompass the flowers.

18 Claims, 5 Drawing Sheets

FLORAL SHIPPING CONTAINER

CROSS-REFERENCE TO RELATED APPLICATIONS

Not applicable.

STATEMENT REGARDING FEDERALLY SPONSORED RESEARCH AND DEVELOPMENT

Not applicable.

SUMMARY OF THE INVENTION

In general, the present invention relates to a floral shipping container for shipping flowers in a growing medium, such as water, and a method for shipping a flower in a growing medium, such as water. Generally, the floral shipping container is provided with a base portion, at least one tube, and a lid.

The base portion is substantially rigid. The base portion is provided with a sidewall, an upper end, a lower end and a retaining space encompassed by the sidewall, the upper end, and the lower end thereof. The upper end of the base portion can be open, and the lower end of the base portion can be closed. The tube defines a reservoir adapted to receive at least one flower and the growing medium. The tube is supported in the base portion by the upper end of the base portion such that at least a portion of the tube extends into the retaining space of the base portion. The lid is supported by the base portion such that the lid extends above the upper end of the base portion to encompass the flowers disposed in the tube.

Other features of the present invention will become apparent to those of ordinary skill in the art when the following written description is read in conjunction with the attached drawings and the appended claims.

BRIEF DESCRIPTION OF THE SEVERAL VIEWS OF THE DRAWING

FIG. 6 is a perspective view of a lid of a floral shipping container constructed in accordance with the present invention wherein the lid includes a handle in an upper end thereof.

DETAILED DESCRIPTION OF THE PREFERRED EMBODIMENT

Figure 1:
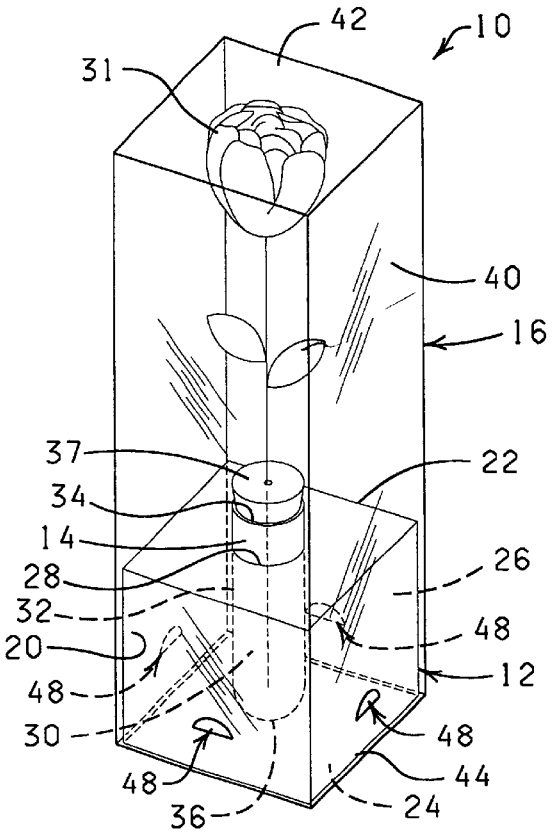
FIG. 1 is a perspective view of a floral shipping container constructed in accordance with the present invention wherein a single tube is disposed within the floral shipping container.

Referring now to the drawings, and in particular to FIG. 1, shown therein and designated by the general reference numeral 10 is a floral shipping container constructed in accordance with the present invention. The floral shipping container 10 permits one or multiple flowers to be shipped from one location to another location while the stem or stems of the one or multiple flowers is maintained in a growing medium, such as water. In one preferred embodiment, the floral shipping container 10 is provided with a base portion 12, a tube 14, and a lid 16.

The base portion 12 is provided with at least a sidewall 20, an upper end 22, a closed lower end 24, and a retaining space 26. The retaining space 26 is encompassed by the sidewall 20, the upper end 22, and the closed lower end 24. An opening 28 is formed through the upper end 22 of the base portion 12. The opening 28 is sized and dimensioned to receive the tube 14 such that the tube 14 fits snugly within the opening 28 so that the upper end 22 of the base portion 12 at least partially supports the tube 14.

As shown in FIG. 1, the sidewall 20 of the base portion 12 includes four sections which are connected at the respective edges thereof to form a substantially rectangularly shaped sidewall 20. However, the particular number of sections forming the sidewall 20 is not critical. In this regard, it should be understood that the sidewall 20 can be provided with a cylindrical shape, an elliptical shape, a triangular shape, a hexagonal shape, or any other asymmetrical, symmetrical or fanciful shape as may be desired.

The sidewall 20, the upper end 22, and the closed lower end 24 of the base portion 12 are constructed of a substantially rigid material or materials, such as plastic, cardboard, metal and combinations thereof.

Figure 2:
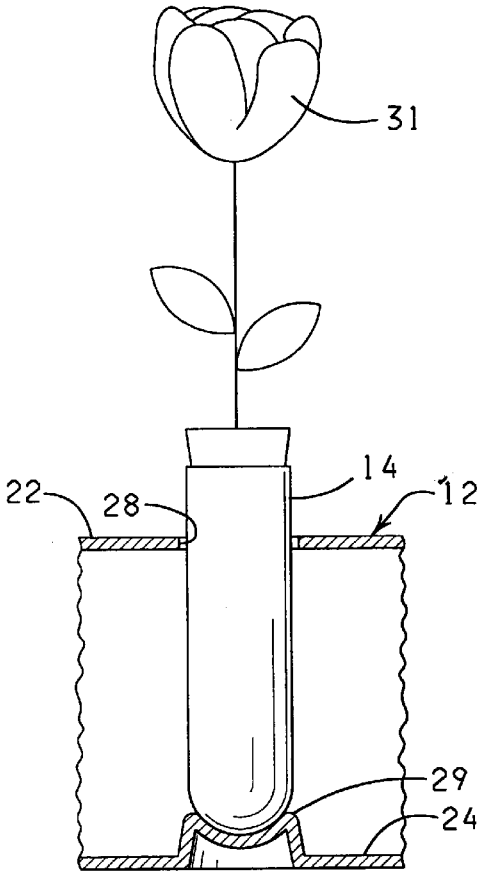
FIG. 2 is a side view, partially in cross section, of the floral container of FIG. 1 having a tube supported therein, the floral shipping container having a raised portion on the lower end of the base portion for maintaining the tube in a stable position relative to the floral shipping container.

Referring to FIG. 2, the base portion 12 optionally includes a raised portion 29 disposed in the retaining space 26 so as to be aligned with the opening 28 provided in the upper end 22 of the base portion 12. The raised portion 29 is connected to or formed on the lower end 24 of the base portion 12. The tube 14 engages the raised portion 29 when the tube 14 is disposed in the opening 28 so as to prevent lateral movement of the tube 14. The raised portion 29 can either be integrally formed with the lower end 24 of the base portion 12, or can be a separate member which is connected to the lower end 24 of the base portion 12. The raised portion 29 will be discussed in more detail hereinafter.

Referring again to FIG. 1, the tube 14 defines a reservoir 30 adapted to receive at least one flower 31. The tube 14, which is disposed through the opening 28 in the upper end 22 of the base portion 12, is supported by the portion of the upper end 22 of the base portion 12 surrounding the opening 28. The tube 14 extends into the retaining space 26 of the base portion 12. In general, the tube 14 is provided with a sidewall 32, which extends between an upper end 34 and a lower end 36 thereof. As shown in FIG. 1, the tube 14 includes one continuous sidewall 32 so as to provide the tube with a cylindrical shape. However, it should be understood that the tube 14 can have any one of a number of different configurations or shapes. The tube 14 is constructed of a substantially rigid fluid impermeable material, such as plastic or glass.

The upper end 34 of the tube 14 is open so that growing medium, such as water, and the stem of the flower 31 can be disposed through the upper end 34 and into the tube 14. The lower end 36, on the other hand, is closed so as to maintain the growing medium, and the flower 31 in the tube 14. As shown in FIG. 2, the lower end 36 of the tube 14 engages the raised portion 29 such that the raised portion 29 stabilizes any lateral movement of the lower end 36 of the tube 14. As shown in FIG. 2, the raised portion 29 can optionally be provided with an indented or recessed portion to matingly receive the lower end 36 of the tube 14.

A stopper 37 can be disposed in the upper end 34 of the tube 14 to prevent spillage of the growing medium, such as water, from the tube 14. The stopper 37 is sized and dimensioned to be matingly disposed into the tube 14 to form a substantially liquid impermeable barrier there between. An opening 38 is provided through the stopper 37 so as to permit the stem of the flower 31 to be disposed through the stopper 37 and into the tube 14.

The lid 16 is supported by the base portion 12 of the floral shipping container 10 such that the lid 16 extends above the upper end 22 of the base portion 12 to encompass the flower 31 substantially as shown. The lid 16 has a shape substantially corresponding to the shape of the base portion 12 so that the lid 16 can be disposed about and supported by the base portion 12. However, it should be understood that the shape of the lid 16 does not have to correspond to the shape of the base portion 12, so long as the lid 16 can be secured to the base portion 12.

The lid 16 is provided with a sidewall 40, which extends between an upper end 42, and a lower end 44 thereof. The upper end 42 of the lid 16 is generally closed so that the upper end 42 and the sidewall 40 cooperate with the base portion 12 so as to fully encompass and protect the flower 31 which is disposed within a cavity 46 defined by the lid 16 and the upper end 22 of the base portion 12.

The lower end 44 of the lid 16 is open, and the lid 16 is sized and dimensioned so that the lower end 44 can be disposed over and past the upper end 22 of the base portion 12 substantially as shown in FIG. 1. The lower end 44 of the lid 16 can be disposed past the upper end 22 of the base portion 12 until the lower end 44 of the lid 16 is substantially aligned with, or alternatively, disposed in close proximity to the lower end 24 of the base portion 12 whereby the lid 16 extends over and substantially encompasses the sidewall 20 of the base portion 12.

The lid 16 can be constructed of a rigid material or materials, such as plastic, metal, cardboard, and/or combinations thereof. In addition, the sidewall 40, and/or the upper end 42 of the lid 16 can be constructed of either an opaque, or a transparent material. It is desirable to form the sidewall 40, and/or the upper end 42 of the transparent material so that the bloom portion of the flower 31 can be seen from outside the floral shipping container 10. Thus, the floral shipping container 10 can also serve to display the flower 31 when the floral shipping container 10 containing the flower 31 is located in a retail establishment. In this regard, the floral shipping container 10 can have decorations, such as images printed thereon, or the like to enhance the aesthetic value of the floral shipping container, and thus, the flower 31 contained within the floral shipping container 10.

In addition, the lid 16 and/or the base portion 12 may have various colorings, coatings, flocking and/or metallic finishes, or other decorative surface ornamentation applied separately or simultaneously thereon. Alternatively, the lid 16 and/or the base portion 12 may be characterized totally or partially by pearlescent, translucent, transparent, iridescent or the like qualities. Each of the above-named characteristics may occur alone or in combination and each surface of the lid 16 and/or the base portion 12 may vary in the combination of such characteristics.

The floral shipping container 10 is optionally provided with a plurality of latch assemblies 48 for securing the lid 16 to the base portion 12. One of the latch assemblies 48 is shown in more detail in FIG. 3. Each latch assembly 48 engages the base portion 12 and the lid 16 so as to securely maintain the lid 16 on the base portion 12.

The latch assemblies 48 are substantially identical in construction and function. Thus, only one of the latch assemblies 48 will be described hereinafter.

The latch assembly 48 is provided with an opening 50, and a latch member 52. The opening 50 is formed through the sidewall 40 of the lid 16. The latch member 52 extends outwardly from the sidewall 20 of the base portion 12. The latch member 52 is positioned such that the latch member 52 is positioned within the opening 50 formed through the sidewall 40 of the lid 16 when the lid 16 is disposed on the base portion 12 so that the latch member 52 engages the sidewall 40 of the lid 16 to prevent removal of the lid 16 from the base portion 12. Thus, the latch assembly 48 securely connects the lid 16 to the base portion 12.

The sidewall 20 of the base portion 12 is formed of an elastic or resilient material, so that the sidewall 20, and thus the latch member 52, can be moved either toward or away from the opening 50 formed in the sidewall 40 of the lid 16. That is, the sidewall 20 can be deformed to move the latch member 52 in a direction generally away from the opening 50 formed in the sidewall 40 for insertion of the lid 16 on the base portion 12, or removal of the lid 16 from the base portion 12. Once the opening 50 formed in the lid 16 is aligned with the latch member 52, the memory of the sidewall of the base portion 12 causes the latch member 52 to be automatically moved into the opening 50.

Figure 3:
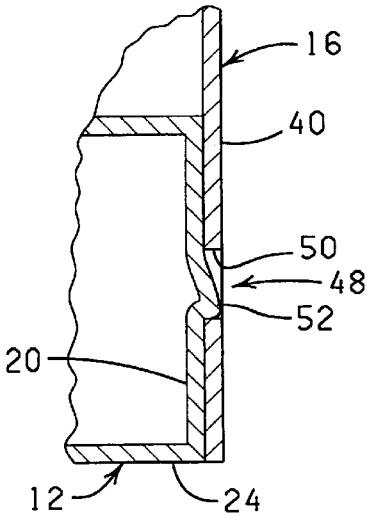
FIG. 3 is a fragmental, cross-sectional view of a latch assembly of a floral shipping container for securing a lid of the floral shipping container on a base portion thereof.

As shown in FIG. 3, the latch member 52 is ramped so as to automatically move the latch member 52 in a direction generally away from the opening 50 as the lid 16 is being inserted onto the base portion 12. The latch member 52 can be formed integrally with the sidewall 20 of the base portion 12 or can be a separate member attached to the sidewall 20 of the base portion 12.

Although the latch assembly 48 has been described as the openings 50 formed through the sidewall 40 of the lid 16, and the latch members 52 extending outwardly from the sidewall 20 of the base portion 12, it should be understood that the openings 50 could be formed through the sidewall 20 of the base portion 12, and the latch members 52 could extend inwardly from the sidewall 40 of the lid 16. Moreover, other embodiments of the latch assembly 48 are contemplated so as to securely maintain the lid 16 on the base portion 12. For example, the latch assembly 48 could be formed of tape, staples, straps and/or combinations thereof to securely maintain the lid 16 on the base portion 12 while permitting removal of the lid 16 from the base portion 12 when desired by an individual without substantially destroying the floral shipping container 10.

In use, the floral shipping container 10 safely ships the flower 31 from a first location to a second location via an suitable shipping service, such as the United States Postal Service, UPS, Federal Express, or the like. Initially, the stem of the flower 31 and the growing medium, such as a quantity of water, are disposed within the reservoir 30 of the tube 14. If it is desired to utilize the stopper 37 to seal the upper end 34 of the tube 14, the stem of the flower 31 is initially disposed through the opening 38 provided in the stopper 37, and then the stopper 37 and the stem of the flower 31 can then be simultaneously inserted into the tube 14. The tube 14 is then supported by the base portion 12 of the floral shipping container 10 by inserting the tube 14 through the opening 28 formed in the upper end 22 of the base portion 12 such that at least a portion of the tube 14 extends into the retaining space 26 of the base portion 12. The lid 16 is then disposed about the bloom of the flower 31 and the base portion 12 until the lower end 44 of the lid 16 is positioned past the upper end 22 of the base portion 12. In this position, the latch assemblies 48 secure the lid 16 to the base portion 12. Once the lid 16 is secured to the base portion 12, the floral shipping container 10 containing the flower 31 can be shipped from the first location to the second location.

Figure 4:
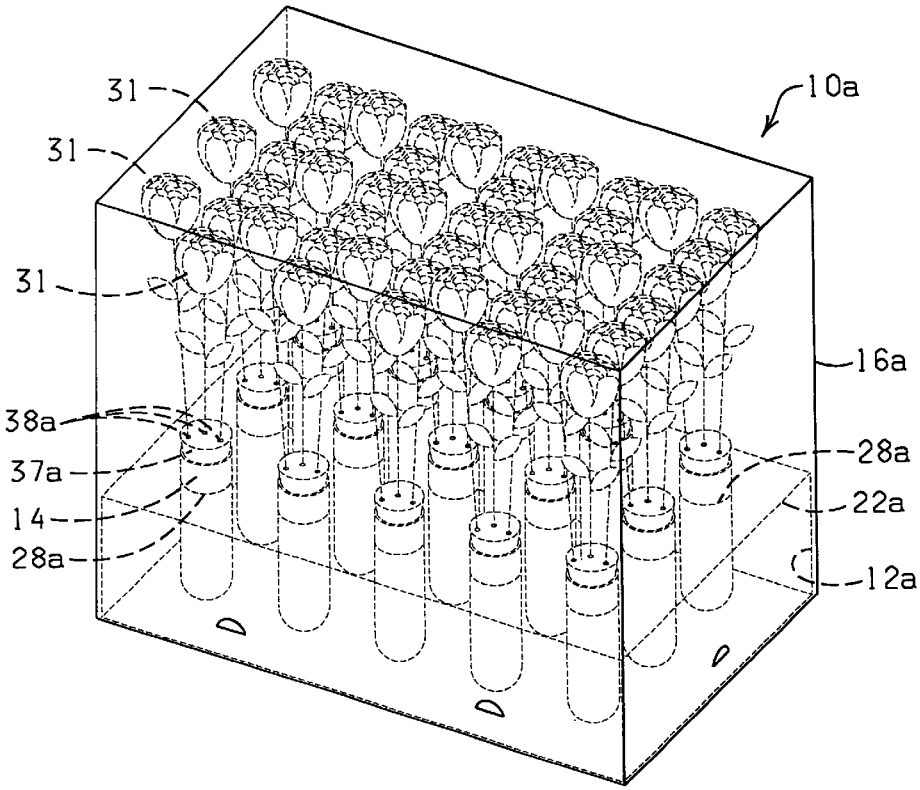
FIG. 4 is a perspective view of another floral shipping container constructed in accordance with the present invention wherein a plurality of tubes are disposed within the floral shipping container.

Referring now to FIG. 4, shown therein and designated by the general reference numeral 10*a* is another embodiment of a floral shipping container constructed in accordance with the present invention. The floral shipping container 10*a* is similar in construction and function to the floral shipping container 10, discussed above with reference to FIG. 1, except as discussed below. The floral shipping container 10*a* includes a base portion 12*a* and a lid 16*a* which are enlarged so as to encompass a plurality of tubes 14. The base portion 12*a* has an upper end 22*a*. The upper end 22*a* of the floral shipping container 10*a* includes a plurality of spatially disposed openings 28*a* formed there through. Only two of the openings 28*a* are numbered in FIG. 4 for purposes of brevity. Each of the openings 28*a* is sized and dimensioned to receive one tube 14 substantially as shown in FIG. 4.

Also shown in FIG. 4, and designated by the general reference numeral 37*a* is another embodiment of a stopper. The stopper 37*a* is similar in construction and function to the stopper 37, except that the stopper 37*a* is provided with a plurality of openings 38*a* each of which is sized and dimensioned to receive at least a portion of the stem of one of the flowers 31 so that multiple flowers 31 can be disposed in each of the tubes 14.

Figure 5:
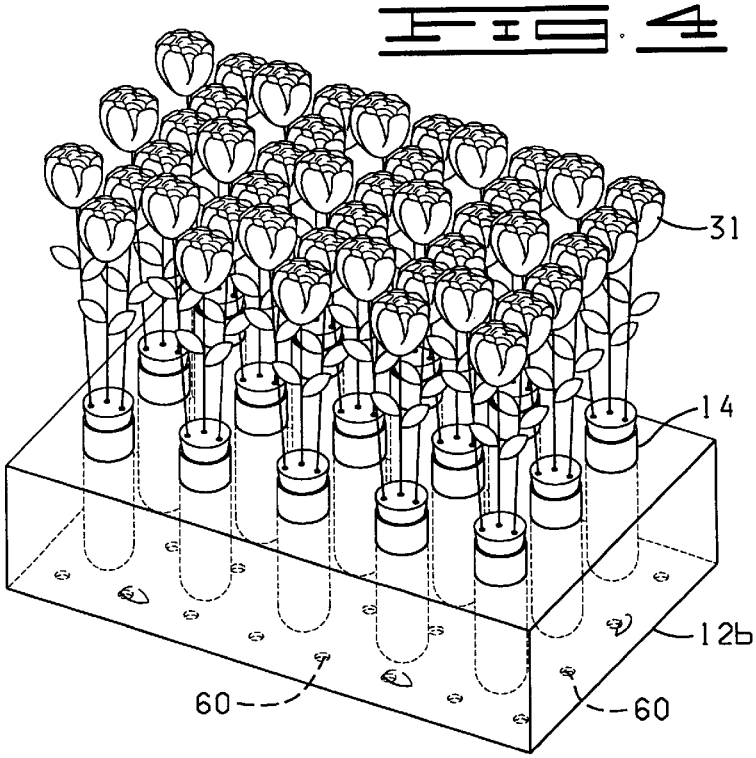
FIG. 5 is a perspective view of a base portion of a floral shipping container constructed in accordance with the present invention wherein the base portion has vent holes formed in a lower end thereof.
Figure 5:
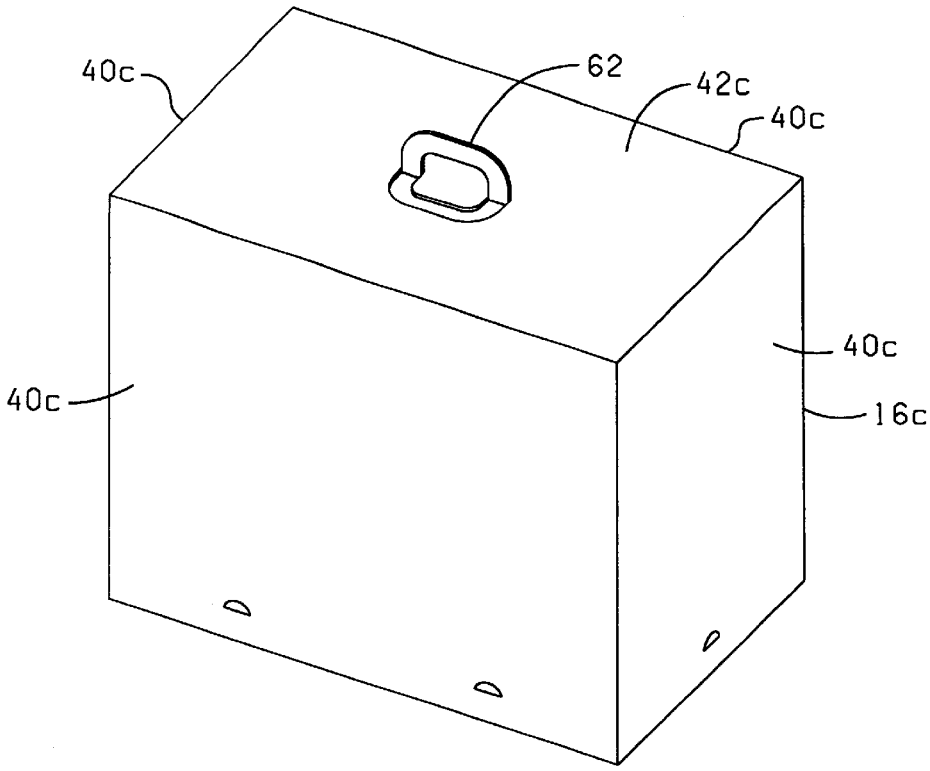

Referring now to FIG. 5, Shown therein and designated by the general reference numeral 12*b* is another embodiment of a base portion constructed in accordance with the present invention. The base portion 12*b* is similar in construction and function to the base portion 12*a*, except that the base portion 12*b* is provided with a plurality of spatially disposed vent holes 60 in a lower end 24*b* of the base portion 12*b*. Only two of the vent holes 60 are numbered in FIG. 5 for purposes of brevity. The vent holes 60 permit air to circulate into the retaining space 26 of the base portion 12*b*.

Referring now to FIG. 6, shown therein and designated by the general reference numeral 16*c* is another embodiment of a lid constructed in accordance with the present invention. The lid 16*c* can be used in conjunction with the base portions 12*a* or 12*b*. The lid 16*c* is similar in construction and function to the lid 16, except that the lid 16*c* includes a handle 62. The handle 62 is hingably connected to an upper end 42*c* of the lid 16*c*. The handle 62 is sized and dimensioned to be gripped by the hand of an individual so that an individual can easily transport the floral shipping container 10*a* having the lid 16*c*. It should be understood that the handle 62 can also be placed on a sidewall 40*c* of the lid 16*c*, or alternatively, two handles 62 can be connected to or formed in the sidewall 40*c* with the handles 62 being spatially disposed, preferably on opposite sides of the lid 16*c*. The handle 62 does not necessarily need to be the U-shaped member shown in FIG. 6; the handle can be any projection extending from the lid 16*c*, or an opening formed through a portion of the lid 16*c* so that a portion of the lid 16*c* can be gripped by an individual.

Figure 7:
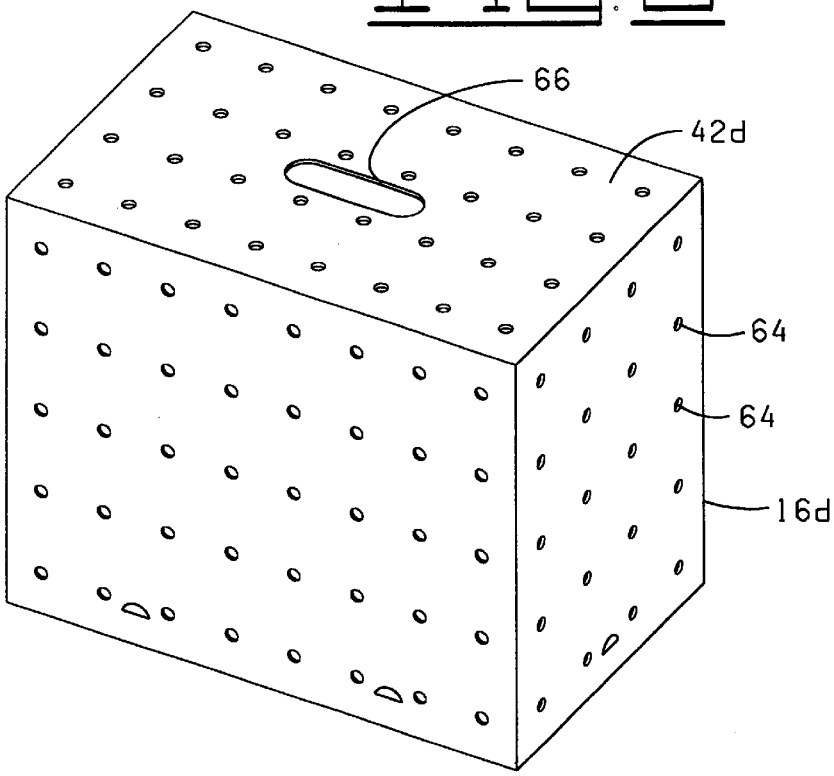
FIG. 7 is a perspective view of another embodiment of a lid of a floral shipping container constructed in accordance with the present invention wherein the lid includes spatially disposed vent holes formed therein.

Referring now to FIG. 7, shown therein and designated by the general reference numeral 16*d* is another embodiment of a lid constructed in accordance with the present invention which can be used in conjunction with the base portions 12*a* or 12*b*. The lid 16*d* is similar in construction and function to the lid 16*c*, except as discussed below. The lid 16*d* includes a plurality of vent holes 64. Only two of the vent holes 64 are numbered in FIG. 7 for purposes of brevity. The vent holes 64 are spatially disposed about the lid 16*d* so as to permit air to circulate through the vent holes 16*d* and about the flowers 31 which can be disposed in the tube 14 when the lid 16*d* is secured to the base portion 12*a* or 12*b*.

The lid 16*d* also includes a finger receiving opening 66 formed through a portion of an upper end 42*d* thereof. The finger receiving opening 66 is sized and dimensioned to receive at least a portion of an individual's hand so as to form a handle in the upper end 42*d* of the lid 16*d*.

Figure 8:
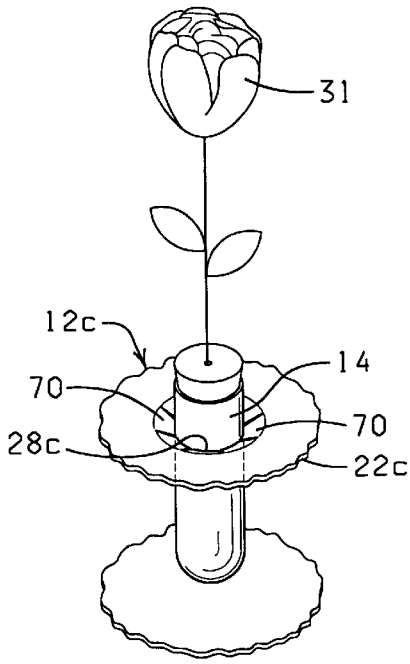
FIG. 8 is a partial, fragmental perspective view of a floral shipping container constructed in accordance with the present invention wherein a plurality of resilient fingers are provided in a base portion to maintain a tube disposed therein in a stable position.

Referring now to FIG. 8, shown therein and designated by the reference numeral 12*c* is another embodiment of a base portion which is constructed in accordance with present invention. The base portion 12*c* is similar in construction and function to the base portions 12, 12*a*, and 12*b* which were described herein before with reference to FIGS. 1, 4, and 5, except as discussed hereinafter. The base portion 12*c* is provided with a plurality of resilient fingers 70 extending about an opening 28*c* formed through an upper end 22*c* of the base portion 12*c*. Only two of the resilient fingers 70 are numbered in FIG. 8 for purposes of clarity. The resilient fingers 70 of the base portion 12*c* permit differently sized tubes 14 to be supported by the base portion 12*c* with each differently sized tube 14 also being engaged and laterally supported by the resilient fingers 70.

Figure 9:
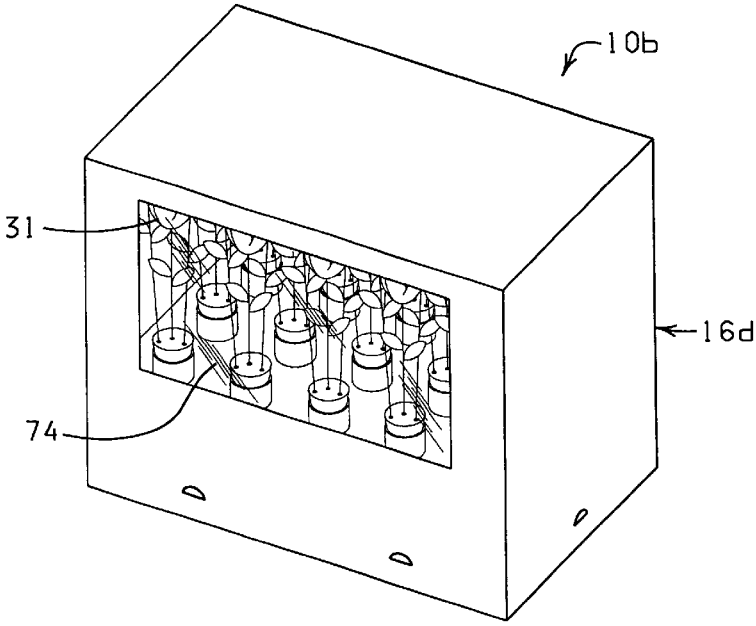
FIG. 9 is a perspective view of a floral shipping container constructed in accordance with the present invention wherein a transparent window is provided in a lid of the floral shipping container.

Referring now to FIG. 9, shown therein and designated by the general reference numeral 10*b* is a floral shipping container which is constructed in accordance with the present invention. The floral shipping container 10*b* is similar in construction and function to the floral shipping container 10*a*, which was described previously with reference to FIG. 4, except that the floral shipping container 10*b* includes a lid 16*d* having a transparent window portion 74 while the remainder of the lid 16*d* is formed of an opaque material so that an individual can look into the floral shipping container 10*b* and perceive the flowers 31 contained therein. The transparent window portion 74 can be constructed of any transparent material, such as plastic. The transparent window portion 74 can be connected to the remainder of the lid 16*d* via any suitable bonding material, such as glue, welds, staples or the like.

Figure 10:
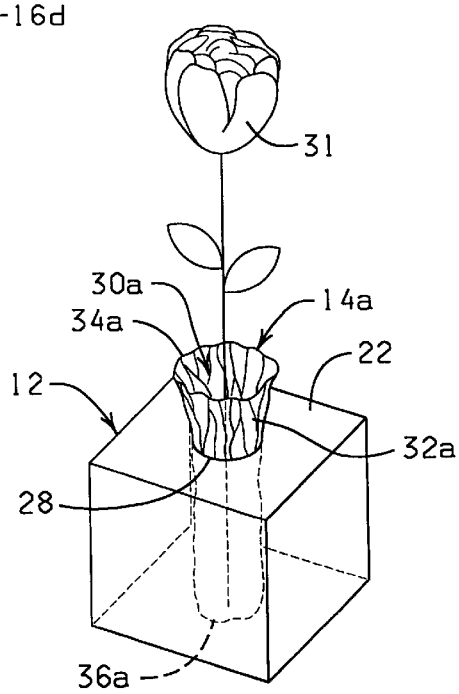
FIG. 10 is a perspective view of a tube constructed in accordance with the present invention, wherein the tube is positioned within a floral shipping container and formed of a flexible material.

Referring now to FIG. 10, shown therein and designated by the general reference numeral 14*a* is another embodiment of a tube constructed in accordance with the present invention. The tube 14*a* can be formed from any flexible, liquid impermeable material, such as a polymeric film, foil or the like. The tube 14*a* has an upper end 34*a*, a lower end 36*a*, and a continuous sidewall 32*a* extending there between. The lower end 36*a* and the continuous sidewall 32*a* cooperate to define a reservoir 30*a*. The tube 14*a* is disposed in the opening 28 formed in the upper end 22 of the base portion 12.

Once the tube 14*a* is disposed the opening 28, the reservoir 30*a* of the tube 14*a* can be at least partially filled with a growing medium such as water and the stem of the flower 31 can be disposed therein.

Figure 11:
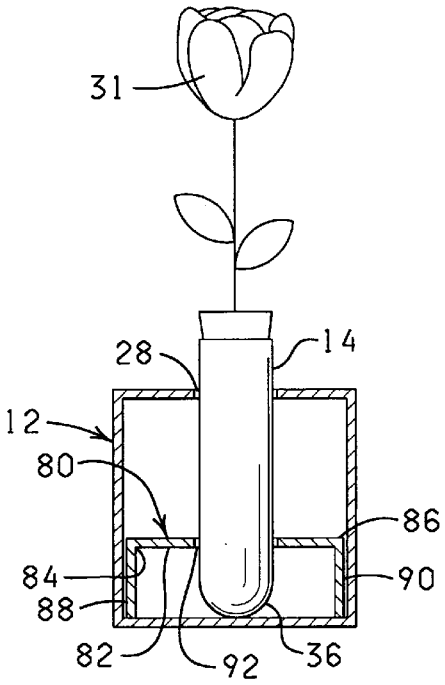
FIG. 11 is an elevational, cross-sectional view of a floral shipping container constructed in accordance with the present invention wherein a tube is disposed within the floral shipping container and secured in a stable condition via a bottom holding device positioned in the base portion of the floral shipping container.

Referring now to FIG. 11, shown therein is the floral shipping container 10 having a bottom holding device 80 for maintaining the lower end 36 of the tube 14 in a laterally stable position. The bottom holding device 80 is formed of a member 82 having an inverted, U-shape. The member 82 can be formed of any suitable material capable of maintaining the lower end 36 of the tube in the laterally stable position. For example, the member 82 can be constructed of a paper product, such as cardboard, or a plastic material. The member 82 can be scored at a first location 84 and a second location 86 to cause two edge portions 88 and 90 to fold downwardly. An opening 92 is formed through the member 82. The opening 92 is sized and dimensioned to receive, and preferably matingly engage, the lower end 36 of the tube 14. The opening 92 is aligned with the opening 28 formed through the upper end 22 of the base portion 12 to maintain the tube 14 in a substantially upright or vertical position.

It should be understood that the bottom holding device 80 can also be utilized and/or formed with the floral shipping containers 10*a* and 10*b*. In these embodiments (not shown), the member 80 would be enlarged, and multiple openings 92 would be formed in the member 80. Each of the openings 92 in this last example would be aligned with one of the openings 28*a* so that each tube 14 would be supported in an upright or vertical position.

Figure 12:
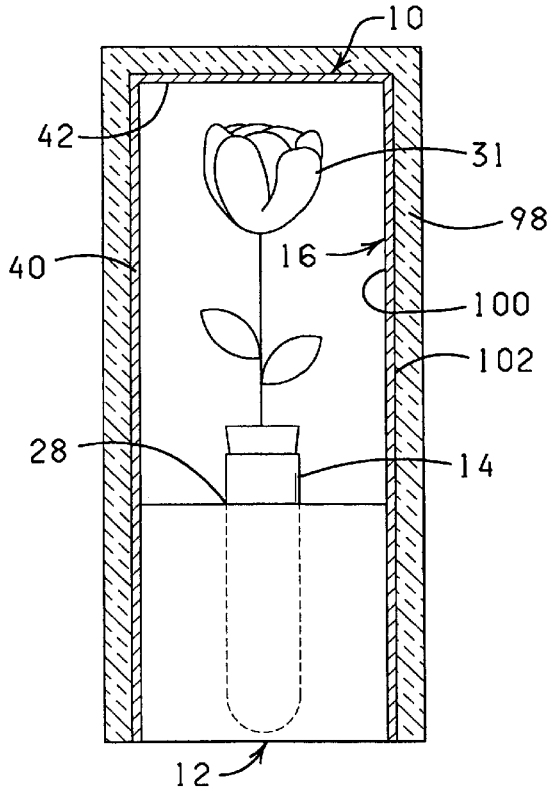
FIG. 12 is an elevational, partial cross-sectional view of the floral shipping container of FIG. 1 having an insulating material disposed about an interior surface thereof.
Figure 13:
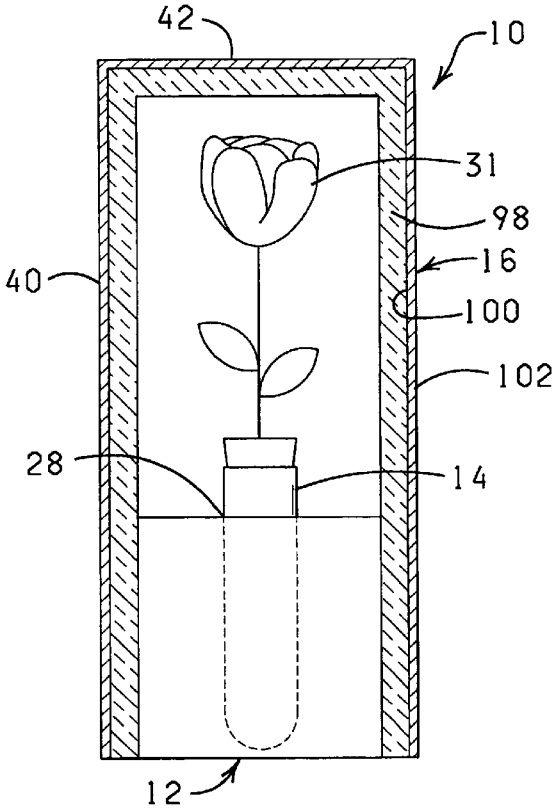
FIG. 13 is an elevational, partial cross-sectional view of the floral shipping container of FIG. 1 having an insulating material disposed about an exterior surface thereof.

Referring now to FIGS. 12 and 13, if it is desired to moderate the temperature within the floral shipping container 10, an insulating material 98 can be disposed about or within at least a portion of the floral shipping container 10 so that temperature fluctuations during shipment of the floral shipping container 10 will not damage the flower 30 contained therein. The lid 16 of the floral shipping container 10 has an interior surface 100 and an exterior surface 102. The insulating material 98 can either be disposed adjacent to the interior surface 100 (as shown in FIG. 13) or the exterior surface 102 (as shown in FIG. 12) such that the insulating material 98 extends about substantially the entire sidewall 40 and the upper end 42 of the lid 16.

The insulating material 98 can be any material which is desirably light weight, and capable of insulating the floral shipping container 10 so as to prevent damage of the flower 30 due to temperature fluctuations. For example, the insulating material 98 can be constructed of styrofoam, or a spray-on insulating material.

Figure 14:
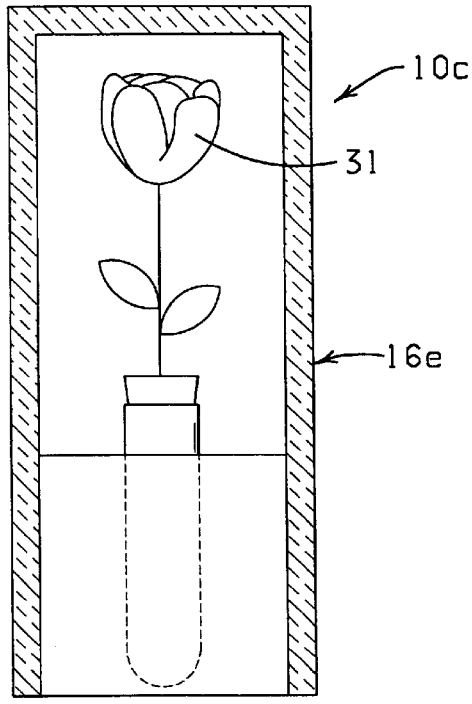
FIG. 14 is an elevational, partial cross-section view of a floral shipping container constructed in accordance with the present invention.

Referring now to FIG. 14, shown therein and designated by the reference numeral 10*c* is another embodiment of a floral shipping container constructed in accordance with the present invention. The floral shipping container 10*c* is similar in construction and function as the floral shipping container 10, except that a lid 16*e* of the floral shipping container 10*c* is constructed of an insulating material, such as rigid styrofoam, so as to moderate the temperature within the floral shipping container 10*c* thereby reducing the likelihood that the flower(s) 30 contained within the floral shipping container 10*c* will be damaged due to temperature fluctuations during shipment.

A scent may be applied to the floral shipping containers 10, 10*a*, 10*b*, 10*c* and 10*d* disclosed herein so that the floral shipping containers 10, 10*a*, 10*b*, 10*c* and 10*d* exude a fragrance. For example, the floral shipping containers 10, 10*a*, 10*b*, 10*c* and 10*d* may be scented with a floral scent, (flower blossoms, or any portion of a plant), food scent (chocolate, sugar, fruits), herb or spice scent (cinnamon), or the like. Such scents are well known in the art and are commercially available.

The scent may be disposed upon the floral shipping containers 10, 10*a*, 10*b*, and 10*c* by spraying the scent thereupon, painting the scent thereupon, brushing the scent thereupon, lacquering the scent thereupon, immersing the floral shipping containers 10, 10*a*, 10*b*, and 10*c* in a scent-containing liquid, exposing the floral shipping containers 10, 10*a*, 10*b*, and 10*c* to scent-containing gas, or any combinations thereof.

The scent may be contained within a lacquer, or other liquid, before it is disposed upon the floral shipping containers 10, 10*a*, 10*b*, and 10*c*. The scent may also be contained within a dye, ink, and/or pigment (not shown). Such dyes, inks and pigments are known in the art, and are commercially available, and may be disposed upon or incorporated in floral shipping containers 10, 10*a*, 10*b*, and 10*c* described herein by any method described herein or known in the art.

Changes may be made in the various elements, components, parts and assemblies described herein or in the steps or sequences of steps in the methods described herein without departing from the spirit and the scope of the invention as defined in the following claims.

What is claimed is:

1. A shipment, comprising:

a flower;

a growing medium;

a base portion having a sidewall, an open upper end, a closed lower end and a retaining space encompassed by the sidewall, the upper end, and the lower end thereof, the sidewall and the upper end of the base portion being constructed of a substantially rigid material;

a tube defining a reservoir and receiving at least one flower and the growing medium, the tube supported by the upper end of the base portion such that the tube extends into the retaining space of the base portion; and a lid supported by the base portion such that the lid extends above the upper end of the base portion to encompass the flower, the lid being constructed of a substantially rigid material.

2. The shipment of claim 1, wherein the upper end of the base portion includes a plurality of spatially disposed openings formed there through with each of the openings being sized and dimensioned to receive on tube and with one tube being disposed in each of the openings.

3. The shipment of claim 1, further comprising a stopper disposed in the tube to prevent spillage of the growing medium from the tube, the stopper including at least one opening formed there through, each opening being sized and dimensioned to receive at least a portion of a stem of the flower.

4. The shipment of claim 3, wherein a plurality of openings are formed in the stopper with each opening. being sized and dimensioned to receive at least a portion of a flower.

5. The shipment of claim 1, wherein the lower end of the base portion defines a plurality of spatially disposed vent holes formed in the lower end of the base portion so as to permit air to circulate into the retaining space of the base portion.

6. The shipment of claim 1, wherein the lid comprises a handle connected to the upper end of the lid, the handle being sized and dimensioned to be gripped by the hand of an individual.

7. The shipment of claim 6, wherein the handle is further defined as a U-shaped member sized and dimensioned to be gripped by the hand of an individual.

8. The shipment of claim 1, wherein the lid defines a plurality of vent holes with the vent holes being spatially disposed about the lid so as to permit air to circulate about the flower.

9. The shipment of claim 1, wherein the base portion comprises an opening formed through the upper end of the base portion to receive the tube and the base portion further comprises a plurality of resilient fingers extending about the opening formed through the upper end of the base portion, the resilient fingers engaging the tube so as to maintain the tube in a stable position.

10. The shipment of claim 1, further comprising a latch assembly engaging the base portion and the lid so as to securely maintain the lid on the base portion.

11. The shipment of claim 10, wherein the lid includes a sidewall, and the latch assembly comprises:

an opening formed through the sidewall of the lid; and a member extending outwardly from the sidewall of the base portion with the latch member being positioned such that the latch member is positioned within the opening formed through the sidewall of the lid when the lid is disposed on the base portion so as to securely maintain the lid on the base portion.

12. The shipment of claim 1, wherein the lid further comprises a transparent window such that an individual can look into the floral shipping container.

13. The shipment of claim 1, wherein a raised portion is formed on the lower portion of the base portion, the raised portion being contoured to receive a lower end of the tube so as to cooperate with the upper end of the base portion to securely maintain the tube in a stable position.

14. The shipment of claim 13, wherein the raised portion is contoured so as to matingly receive the lower end of tube.

15. The shipment of claim 1, further comprising a bottom holding device positioned in the base portion between the upper end and the lower end of the base portion, the bottom holding device engaging at least a portion of the tube and cooperating with the upper end of the base portion to maintain the tube in a stable position.

16. The shipment of claim 15, wherein the bottom holding device includes an opening formed there through to receive at least a portion of the tube.

17. The shipment of claim 1, wherein the tube is constructed of a flexible material.

18. A method for shipping at least one flower having a stem, comprising the steps of:

providing a shipment comprising:

a flower;

a growing medium;

a base portion having sidewalls, an upper end, a closed lower end and a retaining space encompassed by the sidewalls, the upper end, and the lower end thereof; and a lid securable to the base portion such that the lid extends above the upper end of the base portion to form a cavity for receiving and encompassing the flower;

disposing the stem of the flower within a tube;

disposing a quantity of water within the tube;

supporting the tube in the base portion such that at least a portion of the tube extends into the retaining space of the base portion, securing the lid to at least a portion of the base portion such that the lid extends above the upper end of the base portion to encompass the bloom of the flower; and shipping the shipment containing the flower from a first location to a second location.

* * * * *

UNITED STATES PATENT AND TRADEMARK OFFICE

CERTIFICATE OF CORRECTION

PATENT NO. : 6,463,697 B2 
DATED : October 15, 2002
INVENTOR(S) : Donald E. Weder et al.

It is certified that error appears in the above-identified patent and that said Letters Patent is hereby corrected as shown below:

Title page,
Item [56], References Cited, FOREIGN PATENT DOCUMENTS, add the following:
-- EP 0164795 Van Meurs, 12/18/1985
NL 7701234 02/1977 --

Column 9,
Line 2, after word "receive" and before word "tube" change word "on" to word -- one --.

Signed and Sealed this

Twenty-second Day of March, 2005

JON W. DUDAS
*Director of the United States Patent and Trademark Office*